United States Patent [19]

Eshelman et al.

[11] 4,223,651

[45] Sep. 23, 1980

[54] SOLENOID VACUUM CONTROL VALVE MEANS AND APPARATUS AND SYSTEM FOR CONTROLLING THE AIR-FUEL RATIO SUPPLIED TO A COMBUSTION ENGINE

[75] Inventors: Philip V. Eshelman, Southfield; Ronald E. Herman, Romeo, both of Mich.

[73] Assignee: Colt Industries Operating Corp, New York, N.Y.

[21] Appl. No.: 9,558

[22] Filed: Feb. 6, 1979

Related U.S. Application Data

[63] Continuation of Ser. No. 863,740, Dec. 23, 1977, abandoned.

[51] Int. Cl.[3] ..... F02M 11/00

[52] U.S. Cl. ..... 123/438; 60/276; 137/625.65

[58] Field of Search ..... 123/32 EE, 136, 32 AE, 123/119 EC, 139 AV, 139 AW, 139 W, 134, ; 60/285, 276, 275; 137/625.65, 596.17

[56] References Cited

U.S. PATENT DOCUMENTS

| | | | |
|---|---|---|---|
| 3,906,910 | 9/1975 | Szluga, Jr. | 60/276 |
| 3,926,154 | 12/1975 | Williams | 123/32 EE |
| 3,994,314 | 11/1976 | Hartley | 137/596.17 |
| 4,005,733 | 2/1977 | Riddel | 137/625.65 |
| 4,050,477 | 9/1977 | Acar | 137/625.65 |

FOREIGN PATENT DOCUMENTS

| | | | |
|---|---|---|---|
| 420762 | 11/1967 | Fed. Rep. of Germany | 137/625.65 |

*Primary Examiner*—Charles J. Myhre
*Assistant Examiner*—R. A. Nelli
*Attorney, Agent, or Firm*—Walter Potoroka, Sr.

[57] ABSTRACT

A carbureting type fuel metering apparatus has an induction passage into which fuel is fed by several fuel metering systems among which are a main fuel metering system and an idle fuel metering system, as generally known in the art; engine exhaust gas analyzing means sensitive to selected constituents of such exhaust gas creates feedback signal means which through associated transducer means become effective for controllably modulating the metering characteristics of the main fuel metering system and the idle fuel metering system; reciprocating type solenoid control valve means is employed for modulating actuating pressure applied to the structure of the main fuel metering system and idle fuel metering system in order to achieve the desired metering functions.

51 Claims, 8 Drawing Figures

SOLENOID VACUUM CONTROL VALVE MEANS AND APPARATUS AND SYSTEM FOR CONTROLLING THE AIR-FUEL RATIO SUPPLIED TO A COMBUSTION ENGINE

This is a continuation of application Ser. No. 863,749, filed Dec. 23, 1977 now abandoned.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governments to be insufficient. Further, such levels of government have also imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, the available technology employable in attempting to attain increases in engine fuel economy is, generally, contrary to that technology employable in attempting to meet the governmentally imposed standards on exhaust emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly-rich (in terms of fuel) fuel-air mixture to the engine combustion chamber means as to thereby reduce the creation of $NO_x$ within the combustion chamber. The use of such overly-rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection system, besides being costly, have not proven to be generally successful in that the system is required to provide metered fuel flow over a very wide range of metered fuel flows. Generally, those injection systems which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: effective aperture area of the injector nozzle; comparative movement required by the associated nozzle pintle or valving member; inertia of the nozzle valving member and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst (as opposed to the "two way" catalyst system well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete. On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinafter described, the prior art has suggested the use of fuel injection means with associated feedback means (responsive to selected indicia of engine operating conditions and parameters) intended to continuously alter or modify the metering characteristics of the fuel injection means. However, at least to the extent hereinafter indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means cannot, at least as presently conceived, provide the degree of accuracy required in the metering of fuel to an associated engine as to assure meeting, for example, the said anticipated exhaust emission standards.

Accordingly, the invention as disclosed, described and claimed is directed generally to the solution of the above and related problems and more specifically to structure, apparatus and systems enabling a carbureting type fuel metering device to meter fuel with an accuracy at least sufficient to meet the said anticipated standards regarding engine exhaust gas emissions.

SUMMARY OF THE INVENTION

According to the invention, for a carburetor having an induction passage therethrough with a venturi therein having a main fuel discharge nozzle situated generally within the venturi and a main fuel metering system communicating generally between a fuel reservoir and the main fuel discharge nozzle, and having an idle fuel metering system communicating generally between a fuel reservoir and said induction passage at a location generally in close proximity to an edge of a variably openable throttle valve situated in said induction passage downstream of the main fuel discharge nozzle, and further having pressure responsive modulating valving means provided to controllably alter the rate of metered fuel flow through each of said main and idle fuel metering systems in response to control signals generated as a consequence of selected indicia of engine operation, has a solenoid valving assembly effective for controllably varying the effective pressure differential to which said modulating valving means are responsive in order to thereby precisely control the rate of metered fuel flow through the said metering systems.

Various general and specific objects and advantages of the invention will become apparent when reference is made to the following detailed description of the invention considered in conjunction with the related drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
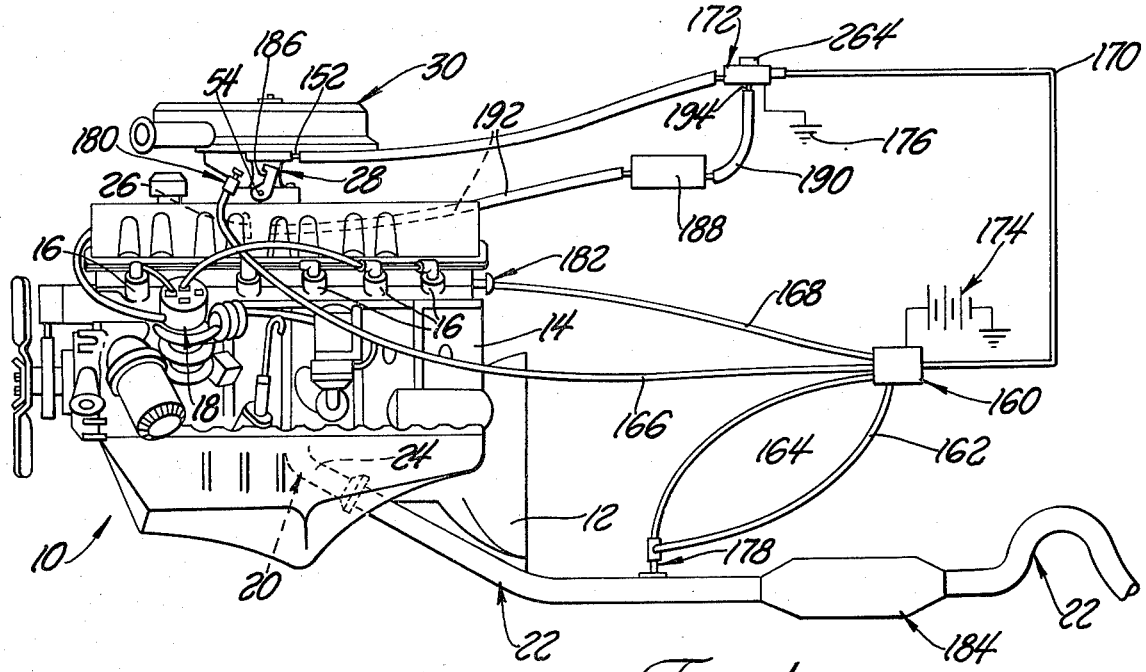
FIG. 1 illustrates, in side elevational view, a vehicular combustion engine employing a carbureting apparatus and system embodying teachings of the invention.

Referring now in greater detail to the drawings, FIG. 1 illustrates a combustion engine 10 used, for example, to propell an associated vehicle as through power transmission means fragmentarily illustrated at 12. The engine 10 may be of the internal combustion type employing, as is generally well known in the art, a plurality of power piston means therein. As generally depicted, the engine assembly 10 is shown as being comprised of an engine block 14 containing, among other things, a plurality of cylinders respectively reciprocatingly receiving said power pistons therein. A plurality of spark or ignition plugs 16, as for example one for each cylinder, are carried by the engine block and respectively electrically connected to an ignition distributor assembly or system 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 to filter the air prior to its entrance into the inlet of the carburetor 28.

Figure 2:
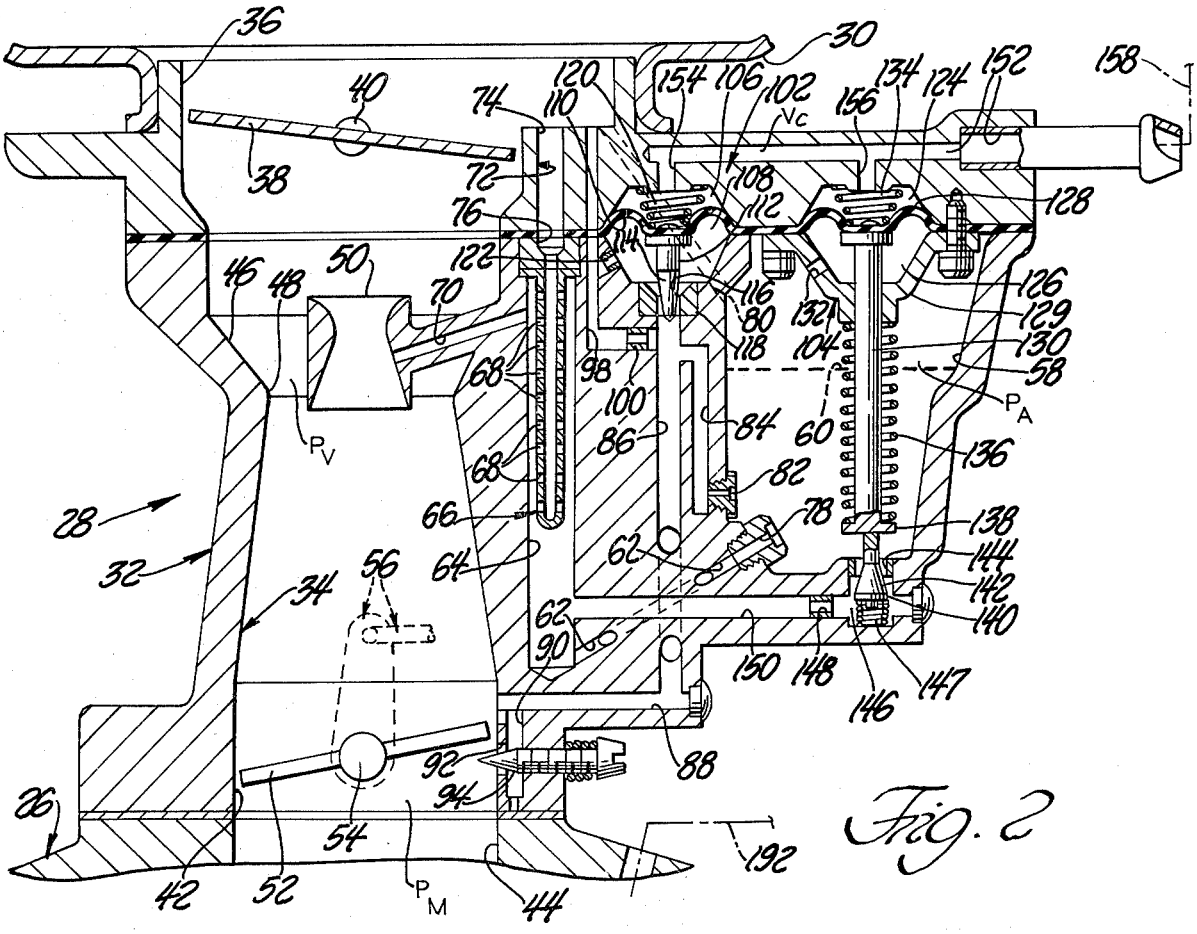
FIG. 2 is an enlarged cross-sectional view of a carburetor assembly, employable in the overall arrangement of FIG. 1.

As generally shown in FIG. 2, the carburetor 28, employing teachings of the invention, comprises a main carburetor body 32 having induction passage means 34 formed therethrough with an upper inlet end 36, in which generally is situated a variably openable choke valve 38 carried as by a pivotal choke shaft 40, and a discharge end 42 communicating as with the inlet 44 of intake manifold 26. A venturi section 46, having a venturi throat 48, is provided within the induction passage means 34 generally between the inlet 36 and outlet or discharge end 42. A main metering fuel discharge nozzle 50, situated generally within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to vehicle operator demand. The throttle valve, as will become more evident, also serves to vary the rate of fuel flow metered by the associated idle fuel metering system and discharged into the induction passage means.

Carburetor body means 32 may be formed as to also define a fuel reservoir chamber 58 adapted to contain fuel 60 therein the level of which may be determined as by, for example, a float operated fuel inlet valve assembly, as is generally well known in the art.

The main fuel metering system comprises passage or conduit means 62 communicating generally between fuel chamber 58 and a generally upwardly extending main fuel well 64 which, as shown, may contain a main well tube 66 which, in turn is provided with a plurality of generally radially directed apertures 68 formed through the wall thereof as to thereby provide for communication as between the interior of the tube 66 and the portion of the well 64 generally radially surrounding the tube 66. Conduit means 70 serves to communicate between the upper part of well 64 and the interior of discharge nozzle 50. Air bleed type passage means 72, comprising conduit means 74 and calibrated restriction or metering means 76, communicates as between a source of filtered air and the upper part of the interior of well tube 66. A main calibrated fuel metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 to the inlet end 36 of induction passage 34.

Generally, when the engine is running, the intake stroke of each power piston causes air flow through the induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity of the air flowing through the venturi is determined by the speed and power output of the engine. The difference between the pressure in the venturi and the air pressure within fuel reservoir chamber 58 causes fuel to flow from fuel chamber 58 through the main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibration of the various controlling elements are such as to cause such main metered fuel flow to start to occur at some pre-determined differential between fuel reservoir and venturi pressure. Such a differential may exist, for example, at a vehicular speed of 30 m.p.h. at normal road load.

Engine and vehicle operation at conditions less than that required to initiate operation of the main metering system are achieved by operation of the idle fuel metering system, which may not only supply metered fuel flow during curb idle engine operation but also at off idle operation.

At curb idle and other relatively low speeds of engine operation, the engine does not cause a sufficient air flow through the venturi section 48 as to result in a venturi vacuum sufficient to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 82 communicating as between the fuel 60, within fuel reservoir or chamber 58, and a generally upwardly extending passage or conduit 84 which, at its upper end, is communication with a second generally vertically extending conduit 86 the lower end of which communicates with a generally laterally extending conduit 88. A downwardly depending conduit 90 communicates at its upper end with conduit 88 while, at its lower end, it communicates with induction passage means 34 as through aperture means 92. The effective size of discharge aperture 92 is variably established as by an axially adjustable needle valve member 94 threadably carried by body 32. As generally shown and as generally known in the art, passage 88 may terminate in a relatively vertically elongated discharge opening or aperture 96 located as to be generally juxtaposed to an edge of throttle valve 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet end 36 of induction passage 34.

At idle engine operation, the greatly reduced pressure area below the throttle valve means causes fuel to flow from the fuel reservoir 58 through restriction means 82 and upwardly through conduit means 84 where, generally at the upper portion thereof, the fuel intermixes with the bleed air provided by conduit 98 and air bleed restriction means 100. The fuel-air emulsion then is drawn downwardly through conduit 86 and through conduits 88 and 90 ultimately discharged, posterior to throttle valve 52, through the effective opening of aperture 92.

During off-idle operation, the throttle valve means 52 is moved in the opening direction causing the juxtaposed edge of the throttle valve to further effectively open and expose a greater portion of the transfer slot or port means 96 to the manifold vacuum existing posterior to the throttle valve. This, of course, causes additional metered idle fuel flow through the transfer port means 96. As the throttle valve means 52 is opened still wider and the engine speed increases, the velocity of air flow through the induction passage 34 increases to the point where the resulting developed venturi vacuum is sufficient to cause the hereinbefore described main metering system to be brought into operation.

The invention as herein disclosed and described provides means, in addition to those hereinbefore described, for controlling and/or modifying the metering characteristics otherwise established by the fluid circuit constants previously described. In the embodiment disclosed, among other cooperating elements, valving assemblies 102 and 104 are provided to enable the performance of such modifying and/or control functions.

For example, valving assembly 102 is illustrated as comprising variable and distinct chambers 106 and 108 effectively separated as by a pressure responsive wall or diaphragm member 110 which, in turn, has a valving member 112 operatively secured thereto for movement therewith. The valving surface 114 of valving member 112 cooperates with a calibrated aperture 116 of a member 118 as to thereby variably determine the effective cross-sectional flow area of said aperture 116 and therefore the degree to which communication between the upper portion of conduit 86 and chamber 108 is permitted. Resilient means, as in the form of compression spring 120 situated generally in chamber 106, serves to continually bias and urge diaphragm member 110 and valving member 112 toward a fully closed position against coacting aperture 116. As shown, chamber 108 is placed in communication with ambient atmosphere preferably through associated calibrated restriction or passage means 122 and via conduit means 98. Without at this time considering the overall operation, it should be apparent that for any selected differential between the manifold vacuum, $P_m$, and the pressure, $P_a$, within reservoir 58, the "richness" of the fuel delivered by the idle fuel metering system can be modulated merely by the moving of valving member 112 toward and/or away from coacting aperture means 116. That is, for any such given pressure differential, the greater the effective opening of aperture means 116 becomes the more air is bled into the idle fuel passing from conduit 84 into conduit 86. Therefore, because of such proportionately greater rate of flow if idle bleed air, the less, proportionately, is the rate of metered idle fuel flow thereby causing a reduction in the richness (in terms of fuel) in the fuel-air mixture supplied through the induction passage 34 and into the intake manifold 26. The converse is also true; that is, as aperture means 116 is more nearly totally closed, the total rate of flow of idle bleed air becomes increasingly more dependent upon the comparatively reduced effective flow area of restriction means 100 thereby proportionately reducing the rate of idle bleed air and increasing, proportionately, the rate of metered idle fuel flow. Accordingly, there is an accompanying increase in the richness (in terms of fuel) in the fuel-air mixture supplied through induction passage 34 and into the intake manifold 26.

Valving assembly 104 is illustrated as comprising upper and lower variable and distinct chambers 124 and 126 separated as by a pressure responsive wall or diaphragm member 128 to which is secured one end of a valve stem 130 as to thereby move in response to and in accordance with the movement of wall or diaphragm means 128. The structure 129 defining the lower portion of chamber 126 serves to provide guide surface means for guiding the vertical movement of valve stem 130 and the chamber 126 is vented to atmospheric pressure, $P_a$, as by vent or aperture means 132.

A first compression spring 134 situated generally within chamber 124 continually urges valve stem 130 in a downward direction as does a second spring 136 which is carried generally about the stem 130 and axially contained as between structure 129 and a movable spring abutment 138 carried by stem 130.

An extension of stem 130 carries a valve member 140 with a valve surface 142, formed thereon, adapted to cooperate with a valving orifice 144 communicating generally between chamber 58 and a chamber-like area 146 which, in turn, communicates as via calibrated metering or restriction means 148 and conduit means 150 with a portion of the main metering system downstream of the main metering restriction means 78. As illustrated, such communication may be at a suitable point within the main well 64. Additional spring means 147 which may be situated generally in the chamber-like area 146, serve to continually urge valve member 142 and stem 130 upwardly.

Without at this time considering the overall operation of the invention, it should be apparent that for any selected metering pressure differential between the venturi vacuum, $P_v$, and the pressure, $P_a$, within reservoir 58, the "richness" of the fuel delivered by the main fuel metering system can be modulated merely by the moving of valving member 140 toward and/or away from coacting aperture means 144. That is, for any such given metering pressure differential, the greater the effective opening of aperture means 144 becomes, the greater also becomes the rate of metered fuel flow since one of the factors controlling such rate is the effective area of the metering orifice means. With the opening of orifice means 144 it can be seem that the then effective metering area of orifice means 144 is, generally, additive to the effective metering area of orifice means 78. Therefore, a comparatively increased rate of metered fuel flow is consequently discharged, through nozzle 50, into the induction passage means 34. The converse is also true; that is, as aperture means 144 is more nearly or totally closed, the total effective main fuel metering area decreases and approaches that effective metering area determined by metering means 78. Consequently, the total rate of metered main fuel flow decreases and a comparatively decreased rate of metered fuel flow is discharged through nozzle 50, into the induction passage 34.

As shown, chamber 106 and 124 are each in communication with conduit means 152, as via conduit means 154 and 156, respectively.

As illustrated in FIG. 1, conduit means 152 is placed in communication with associated conduit means 158 effective for conveying a fluid control pressure to said conduit 152 and chambers 106 and 124. For purposes of illustration, such control pressure will be considered as being sub-atmospheric and to that extent a control vacuum, $V_c$, the magnitude of which, of course, increases as the absolute value of the control pressure decreases.

FIG. 1 also illustrates suitable logic control means 160 which, as contemplated in the preferred mode of operation of the invention, may be electrical logic control means having suitable electrical signal conveying conductor means 162, 164, 166 and 168 leading thereto for applying electrical input signals, reflective of selected operating parameters, to the circuitry of logic means 160. It should, of course, be apparent that such input signals may convey the required information in terms of the magnitude of the signal as well as conveying information by the absence of the signal itself. Output electrical conductor means, as at 170, serves to convey the output electrical control signal from the logic means 160 to associated electrically-operated control valve means 172. A suitable source of electrical potential 174 is shown as being electrically connected to logic means 160, while control valve means 172 may be electrically grounded, as at 176.

In the preferred embodiment, the various electrical conductor means 162, 164, 166 and 168 are respectively connected to parameter sensing and transducer signal producing means 178, 180 and 182. In the embodiment shown, the means 178 comprises oxygen sensor means communicating with exhaust conduit means 22 at a point generally upstream of a catalytic converter 184. The transducer means 180 may comprise electrical switch means situated as to be actuated by cooperating lever means 186 fixedly carried, as by the throttle shaft 54, and swingably rotatable therewith into and out of operating engagement with switch means 180, in order to thereby provide a signal indicative of the throttle 52 having attained a preselected position.

The transducer 182 may comprise suitable temperature responsive means, such as, for example, thermocouple means, effective for sensing engine temperature and creating an electrical signal in accordance therewith.

A vacuum reservoir or tank 188 is shown being preferably operatively connected and in communication with control valve 172, as by conduit means 190, and with the interior of the intake manifold 26 (serving as a source of engine or manifold vacuum, $P_m$) as by conduit means 192.

Figure 5:
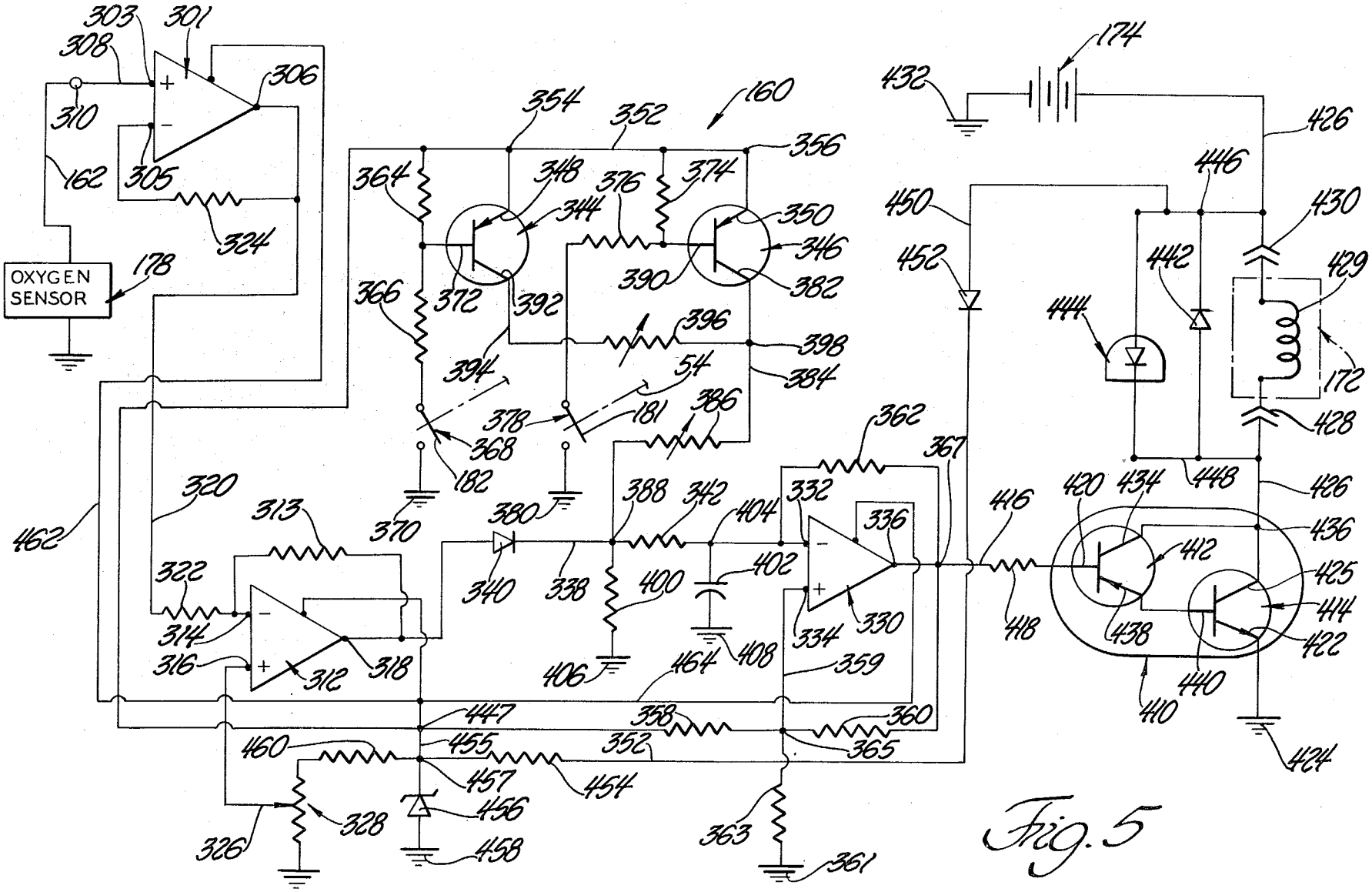
FIG. 5 is a schematic wiring diagram of circuitry employable in association with the invention.

FIG. 5 illustrates, by way of example, a form of circuitry employable as the logic circuitry 160 of FIG. 1. Referring now in greater detail to FIG. 5, such a one embodiment of the control and logic circuit means 160 is illustrated as comprising first operational amplifier 301 having input terminals 303 and 305 along with output terminal means 306. Input terminal 303 is electrically connected as by conductor means 308 and a connecting terminal 310 as to output electrical conductor means 162 leading from the oxygen sensor 178. Although the invention is not so limited, it has, nevertheless, been discovered that excellent results are obtainable by employing an oxygen sensor assembly produced commercially by the Electronics Division of Robert Bosch GmbH of Schwieberdingen, Germany and as generally illustrated and described on pages 137–144 of the book entitled "Automotive Electronics II" published February 1975, by the Society of Automotive Engineers, Inc., 400 Commonwealth Drive, Warrendale, Pa., bearing U.S.A. copyright notice of 1975, and further identified as SAE (Society of Automotive Engineers, Inc.) Publication No. SP-393. Generally, such an oxygen sensor comprises a ceramic tube or cone of zirconium dioxide doped with selected metal oxides with the inner and outer surfaces of the tube or cone being coated with a layer of platinum. Suitable electrode means are carried by the ceramic tube or cone as to thereby result in a voltage thereacross in response to the degree of oxygen present in the exhaust gases flowing by the ceramic tube. Generally, as the presence of oxygen in the exhaust gases decreases, the voltage developed by the oxygen sensor decreases.

A second operational amplifier 312 has input terminals 314 and 316 along with output terminal means 318. Inverting input terminal 314 is electrically connected as by conductor means 320 and resistor means 322 to the output 306 of amplifier 301. Amplifier 301 has its inverting input 305 electrically connected via feedback circuit means, comprising resistor 324, electrically connected to the output 306 as by conductor means 320. The input terminal 316 of amplifier 312 is connected as by conductor means 326 to potentiometer means 328.

A third operational amplifier 330, provided with input terminals 332 and 334 along with output terminal means 336, has its inverting input terminal 332 electrically connected to the output 318 of amplifier 312 as by conductor means 338 and diode means 340 and resistance means 342 serially situated therein.

First and second transistor means 344 and 346 each have their respective emitter terminals 348 and 350 electrically connected, as at 354 and 356, to conductor means 352 leading to the conductor means 445 and 447. A resistor 358, has one end connected to conductor 445 and its other resistor end connected to conductor 359 leading from input terminal 334 to ground 361 as through a resistor 363. Further a resistor 360 has its opposite ends electrically connected as at points 365 and 367 to conductors 359 and 416. A feedback circuit comprising resistance means 362 is placed as to be electrically connected to the output and input terminals 336 and 332 of amplifier 330.

A voltage divider network comprising resistor means 364 and 366 has one electrical end connected to conductor means 352 as at a point between 354 and resistor 358. The other electrical end of the voltage divider is connected as to switch means 368 which, when closed, completes a circuit as to ground at 370. The base terminal 372 of transistor 344 is connected to the voltage divider as at a point between resistors 364 and 366.

A second voltage divider network comprising resistor means 374 and 376 has one electrical end connected to conductor means 352 as at a point between 354 and 356. The other electrical end of the voltage divider is connected as to second switch means 378 which, when closed, completes a circuit as to ground at 380. The base terminal 390 of transistor 346 is connected to the voltage divider as at a point between resistors 374 and 376. Collector electrode 382 of transistor 346 is electrically connected, as by conductor means 384 and serially situated resistor means 386 (which, as shown, may be a variable resistance means), to conductor means 338 as at a point 388 generally between diode 340 and resistor 342. Somewhat similarly, the collector electrode 392 of transistor 344 is electrically connected, as by conductor means 394 and serially situated resistor means 396 (which, as shown, may also be a variable resistance means), to conductor means 384 as at a point 398 generally between collector 382 and resistor 386.

As also shown, resistor and capacitor means 400 and 402 have their respective one electrical ends or sides connected to conductor means as at points 388 and 404 while their respective other electrical ends are connected to ground as at 406 and 408. Point 404 is, as shown, generally between input terminal 332 and resistor 342.

A Darlington circuit 410, comprising transistors 412 and 414, is electrically connected to the output 336 of operational amplifier 330 as by conductor means 416 and serially situated resistor means 418 being electrically connected to the base terminal 420 of transistor 412. The emitter electrode 422 of transistor 414 is connected to ground 424 while the collector 425 thereof is electrically connected as by conductor means 426 connectable, as at 428 and 430, to related solenoid-like valving means 172, and leading to the related source of electrical potential 174 grounded as at 432.

The collector 434 of transistor 412 is electrically connected to conductor means 426, as at point 436, while the emitter 438 thereof is electrically connected to the base terminal 440 of transistor 414.

Preferably, a diode 442 is placed in parallel with solenoid means 172 and a light-emitting-diode 444 is provided to visually indicate the condition of operation. Diodes 442 and 444 are electrically connected to conductor means 426 as by conductors 446 and 448.

Conductor means 450, connected to source 174 as by means of conductor 446 and comprising serially situated diode means 452 and resistance means 454, is connected to conductor means 455, as at 457, leading generally between amplifier 312 and one side of a zener diode 456 the other side of which is connected to ground as at 458. Additional resistance means 460 is situated in series as between potentiometer 328 and point 457 of conductor 455. Conductor 455 also serves as a power supply conductor to amplifier 312; similarly, conductors 462 and 464, each connected as to conductor means 455, serve as power supply conductor to operational amplifiers 301 and 330, respectively.

Figure 6:
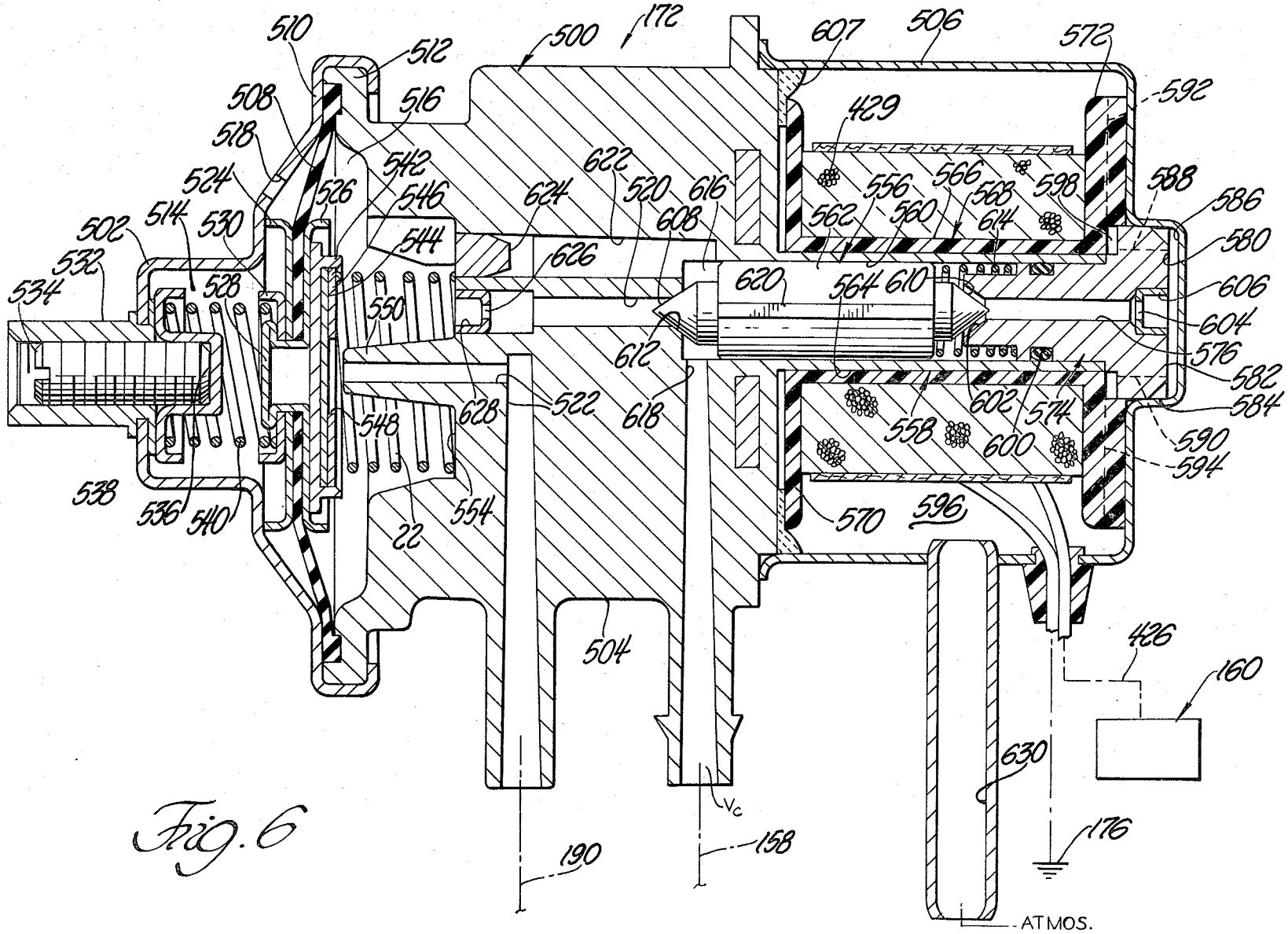
FIG. 6 is a generally longitudinal cross-sectional view of a control valve assembly embodying teachings of the invention.

FIG. 6 illustrates the vacuum control valve assembly of the invention as generally schematically illustrated at 172 of FIG. 1. Referring in greater detail to FIG. 6, valve assembly 172 is illustrated as comprising body means 500 comprised as of body or housing sections 502, 504 and 506 which, as generally depicted, are serially secured to each other by any suitable means.

A pressure responsive movable wall as, for example, in the form of a diaphragm 508 is generally peripherally contained between and cooperatively sealingly retained by generally annular flange like portions 510 and 512 of housing sections 502 and 504, respectively, as to thereby define at opposite sides thereof distinct and variable chambers 514 and 516 with chamber 514 being placed in communication as with ambient atmospheric pressure via port or vent passage means 518 formed through the wall of housing section 502. Chamber 516 is adapted for communication as with passage means 520 and 522 in a manner to be described.

As shown, diaphragm 508 is preferably provided with diaphragm backing plates 524 and 526, situated at opposite sides thereof with backing plate 526 being preferably formed as to have a central portion 528 thereof extend through centrally aligned apertures formed through diaphragm 508, backing plate 524 and a cup-like spring seat 530 and be generally deformed thereagainst in order to thereby form such elements into a subassembly.

Housing section 502 carries a generally centrally positioned, axially extending internally threaded portion 532 which threadably receives therein an adjustment type screw 534 having its inner most end seated as within a cup-like portion 536 of a second annular spring seat 538 which cooperates with opposed spring seat 530 to contain coiled compression spring means 540 therebetween.

Within chamber 516, a cup-like member 542 carries, generally therewithin, a disc-like seal 544 held against member 542 as by an annular member or ring plate washer-like member 546. As generally indicated at 548, washer member 546 is provided with an aperture for accommodating the end of extension portion 550 of housing or body section 504 as to thereby enable the axial end of such extension 550, if need be during operation of the assembly 172, to come into operative contact with seal 544 to terminate communication as between chamber 516 and conduit or passage 522 formed in said extension 550. A coiled compression spring 552, situated about extension 550 is generally axially contained between such washer or spring plate 546 and surface 554 of chamber 516.

Housing section 506, generally, contains the solenoid assembly comprising the field winding 429 and armature which, in this case, is a valving member 556. As can be seen, medial body or housing section 504 has an integrally formed tubular extension 558 which has an inner cylindrical chamber 560 slidably receiving therein body 562 of valving member 556 and which has an outer cylindrical surface 564 for slidably closely receiving thereabout the central tubular portion 566 of a spool member 568 which has radially extending axially spaced annular end walls 570 and 572. As shown, the solenoid winding 429 is carried generally about spool tubular portion 566 and between end walls 570 and 572. A pole piece 574, having a passage 576 formed axially therethrough, is closely received within inner surface 560 of tubular extension 558 and axially retained therein as by an inner surface portion 580 of housing section 506 abutting against the end surface 582 of the head 584 of pole piece 574. An outwardly formed portion 586, in housing section 506, is preferably provided as to define passage like means for completing communication as between relieved or passage means 588 and 590 in pole piece head 584 and passage 576. Further, as generally indicated at 592 and 594, end wall 572 is preferably provided with radially directed passage means as to enhance communication as between the interior 596 of housing section 506 and an annular chamber or space 598 communicating with passage means 588 and 590. An annular seal or O-ring 600 is provided as between the exterior of pole piece 574 and the interior surface 560 of tubular extension 558 as to prevent any pressure leakage therebetween. The left end (as viewed in FIG. 6) of pole piece 574 is provided with a valve seat surface 602 which communicates, at that end, with passage 576. Further, the right end of said passage 576 communicates with passage means 586 as through calibrated orifice or restriction means 604 formed in the end wall of a cup-like member 606 sealingly pressed into the head end 584 of pole piece 574. Further, preferably, the entire spool and winding is axially pressed against an annular seal 607 which also provides for a degree of resilient shimming.

Valving member 556 is provided with oppositely disposed and directed valve portions 608 and 610 with valve portion 608 being adapted to be at times sealingly seated as against a cooperating valve seat 612 formed generally about and communicating with passage 520, while valve portion 610 is adapted to be at times sealingly seated against cooperating valve seat 602. A coiled compression spring 614 generally between pole piece 574 and valve body 562 normally urges valve means 556 to the left as to close communication between the chamber 616, defined by cylindrical surface 560, and passage 520. Even though in the preferred embodiment of the invention, the space or clearance between valve body 562 and inner cylindrical surface 560 is made sufficient to enable the desired air flow to occur as between passage 618 formed in housing section 504 and communicating with chamber 616 at the other end of valve body 562, if desired additional relieved, clearance or passage like means 620 may be formed generally axially along the valve body 562.

An additional passage or conduit 622, which may or may not be formed in the embodiment of FIG. 6, is suitably plugged as by suitable plug means 624 as to effectively seal such passage from any flow therethrough from chamber 516. Passage means 520, at its left end, communicates with chamber 516 as through calibrated orifice or restriction means 626 formed as within an end wall of a cup-like member 628 sealingly pressed into the end of such passage means 520.

As generally depicted, conduit 618 communicates with conduit means 158 (leading to conduits 152, 154 and 156 of FIG. 2), while conduit 522 communicates with a suitable source of vacuum (or reduced pressure) as via conduit means 190. As should be apparent, such a vacuum source may be the vacuum generated as by the venturi within the induction passage means of related carburetor means, or the vacuum generated within the intake manifold of the related engine, or combination of such venturi and manifold vacuum. Further, although not believed necessary and believed to be comparatively more expensive, such vacuum source may also be a separate vacuum pump. Also, accumulator means 188 may or may not be used. However, for ease of reference and for ease of conceiving a particular "source" of vacuum, let it be assumed that such an accumulator means 188 is employed and that, at least for purposes of discussion, such means comprises a "source" of vacuum. Conduit 630, serves to communicate between chamber 596 and a suitable reference pressure as, for example, the ambient atmosphere. (Such, of course, may be via suitable related air cleaner means as to preclude the introduction of dirt particles into chamber 596 and environs.)

OPERATION OF INVENTION

Generally, the oxygen sensor 178 senses the oxygen content of the exhaust gases and, in response thereto, produces an output voltage signal which is proportional or otherwise related thereto. The voltage signal is then applied, as via conductor means 162, to the electronic logic and control means 160 which, in turn, compares the sensor voltage signal to a bias or reference voltage which is indicative of the desired oxygen concentration. The resulting difference between the sensor voltage signal and the bias voltage is indicative of the actual error and an electrical error signal, reflective thereof, is employed to produce a related operating voltage which is applied to the control valve assembly 172 as by conductor means schematically shown at 170.

Manifold or engine vacuum, generated during engine operation, is conveyed as to vacuum reservoir means 188, which, via conduit means 190, conveys such vacuum to conduit portion 522 of control valve assembly 172. The operation of control valve assembly 172 is such as to effectively variably bleed or vent a portion of the vacuum as to ambient atmosphere and thereby determine a resulting magnitude of a control vacuum which is applied to conduit means 158. The magnitude of such control vacuum, $V_c$, is, as previously generally described, determined by the electrical control signal and consequent effective operating voltage applied via conductor means 170 to control valve assembly 172, which comprises the solenoid-operated valve assembly as shown in FIG. 6.

As best seen in FIG. 2, the control vacuum, $V_c$, is applied via conduit means 152 to both pressure responsive motor means 102 and 104, and more specifically to respective chambers 106 and 124 thereof. Generally, as should be apparent, the greater the magnitude of $V_c$ (and therefore the lower its absolute pressure) the more upwardly are wall or diaphragm members 110 and 128 urged. The degree to which such members 110 and 128 are actually moved upwardly depends, of course, on the resilient resistance thereto provided by spring means 120, 134 and 136, as well as the upward resilient force of spring means 147 situated generally in chamber 146 and operatively engaging valve member 142.

Figure 3:
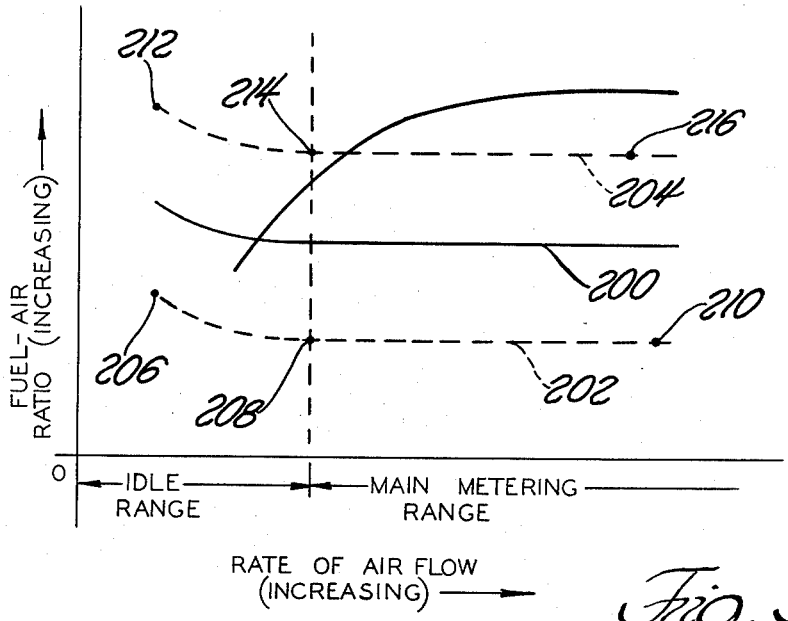
FIG. 3 is a graph illustrating, generally, fuel-air ratio curves obtainable with structures employing the invention.

The graph of FIG. 3 generally depicts fuel-air ratio curves obtainable by the invention. For purposes of illustration, let it be assumed that curve 200 represents a combustible mixture, metered as to have a ratio of 0.068 lbs. of fuel per pound of air. Then, as generally shown, the carbureting device 28 could provide a flow of combustible mixtures in the range anywhere from a selected lower-most fuel-air ratio as depicted by curve 202 to an uppermost fuel-air ratio as depicted by curve 204. A should be apparent, the invention is capable of providing an infinite family of such fuel-air ratio curves between and including curves 202 and 204. This becomes especially evident when one considers that the portion of curve 202 generally between points 206 and 208 is achieved when valve member 112 of FIG. 2 is moved upwardly as to thereby open orifice 116 to its maximum intended effective opening and cause the introduction of a maximum amount of bleed air therethrough. Similarly, that portion of curve 202 generally between points 208 and 210 is achieved when valve member 142 is moved upwardly as to thereby close orifice 144 to its intended minimum effective opening (or totally effectively closed) and cause the flow of fuel therethrough to be terminated or reduced accordingly.

In comparison, that portion of curve 204 generally between points 212 and 214 is achieved when valve member 112 is moved downwardly as to thereby close orifice 116 to its intended minimum effective opening (or totally effectively closed) and cause the flow of bleed air therethrough to be terminated or reduced accordingly. Similarly, that portion of curve 204 generally between points 214 and 216 is achieved when valve member 142 is moved downwardly as to thereby open orifice 144 to its maximum intended opening and cause a corresponding maximum flow of fuel therethrough.

It should be apparent that the degree to which orifices 116 and 144 are respectively opened, during actual operation, depends on the magnitude of the control vacuum, $V_c$, which, in turn, depends on the control signal produced by the logic control means 160 and, of course, the control signal thusly produced by means 160 depends, basically, on the input signal obtained from the oxygen sensor 178, as compared to the previously referred-to bias or reference signal. Accordingly, knowing what the desired composition of the exhaust gas from the engine should be, it then becomes possible to program the logic of means 160 as to create signals indicating deviations from such desired composition as to in accordance therewith modify the effective opening of orifices 116 and 144 to increase and/or decrease the richness (in terms of fuel) of the fuel-air mixture being metered to the engine. Such changes or modifications in fuel richness, of course, are, in turn, sensed by the oxygen sensor 178 which continues to further modify the fuel-air ratio of such metered mixture until the desired exhaust composition is attained. Accordingly, it is apparent that the system disclosed defines a cosed-loop feedback system which continually operates to modify the fuel-air ratio of a metered combustible mixture assuring such mixture to be of a desired fuel-air ratio for the then existing operating parameters.

It is also contemplated, at least in ceratin circumstances, that the upper-most curve 204 may actually be, for the most part, effectively below a curve 218 which, in this instance, is employed to represent a hypothetical curve depicting the best fuel-air ratio of a combustible mixture for obtaining maximum power from engine 10, as during wide open throttle (WOT) operation. In such a contemplated contingency, transducer means 180 (FIG. 1) may be adapted to be operatively engaged, as by lever means 186, when throttle valve 52 has been moved to WOT condition. At that time, the resulting signal from transducer means 180, as applied to means 160, causes logic means 160 to appropriately respond by further altering the effective opening of orifices 116 and 144. That is, if it is assumed that curve portion 214–216 is obtained when effectively opened to a degree less than its actual maximum physical opening, then further effective opening thereof may be accomplished by causing a further downward movement of valve member 140. During such phase of operation, the metering becomes an open loop function and the input signal to logic means 160 provided by oxygen sensor 178 is, in effect, ignored for so long as the WOT signal from transducer 180 exists.

Similarly, in certain engines, because of any of a number of factors, it may be desirable to assure a lean (in terms of fuel richness) base fuel-air ratio (enriched by the well known choke machanism) immediately upon starting of a cold engine. Accordingly, engine temperature transducer means 182 may be employed for producing a signal, over a predetermined range of low engine temperatures, and applying such signal to logic control means 160 as to thereby cause such logic means 160 to, in turn, produce and apply a control signal, via 170, to control valve 172, the magnitude of which is such as to cause the resulting fuel-air ratio of the metered combustible mixture to be, for example, in accordance with curve 202 of FIG. 3 or some other selected relatively "lean" fuel-air ratio.

Further, it is contemplated that at certain operating conditions and with certain oxygen sensors, it may be desirable or even necessary to measure the temperature of the oxygen sensor itself. Accordingly, suitable temperature transducer means, as for example thermocouple means well known in the art, may be employed to sense the temperature of the operating portion of the oxygen sensor means 178 and to provide a signal in accordance or in response thereto as via conductor means 164 to the electronic control means 160. That is, it is anticipated that it may be necessary to measure the temperature of the sensory portion of the oxygen 178 to determine that such sensor 178 is sufficiently hot to provide a meaningful signal with respect to the composition of the exhaust gas. For example, upon restarting a generally hot engine, the engine temperature and engine coolant temperatures could be normal (as sensed by transducer means 182) and yet the oxygen sensor 174 is still too cold and therefore not capable of providing a meaningful signal, of the exhaust gas composition, for several seconds after such re-start. Because a cold catalyst cannot clean up from a rich mixture, it is advantageous, during the time that sensor means 174 is thusly too cold, to provide a relatively "lean" fuel-air ratio mixture. The sensor means 174 temperature signal thusly provided along conductor means 164 may serve to cause such logic means 160 to, in turn, produce and apply a control signal, as via 170 to control valve means 172, the magnitude of which is such as to cause the resulting fuel-air ratio of the metered combustible mixture to be, for example, in accordance with curve 202 of FIG. 3 or some other selected relatively "lean" fuel-air ratio.

Figure 4:
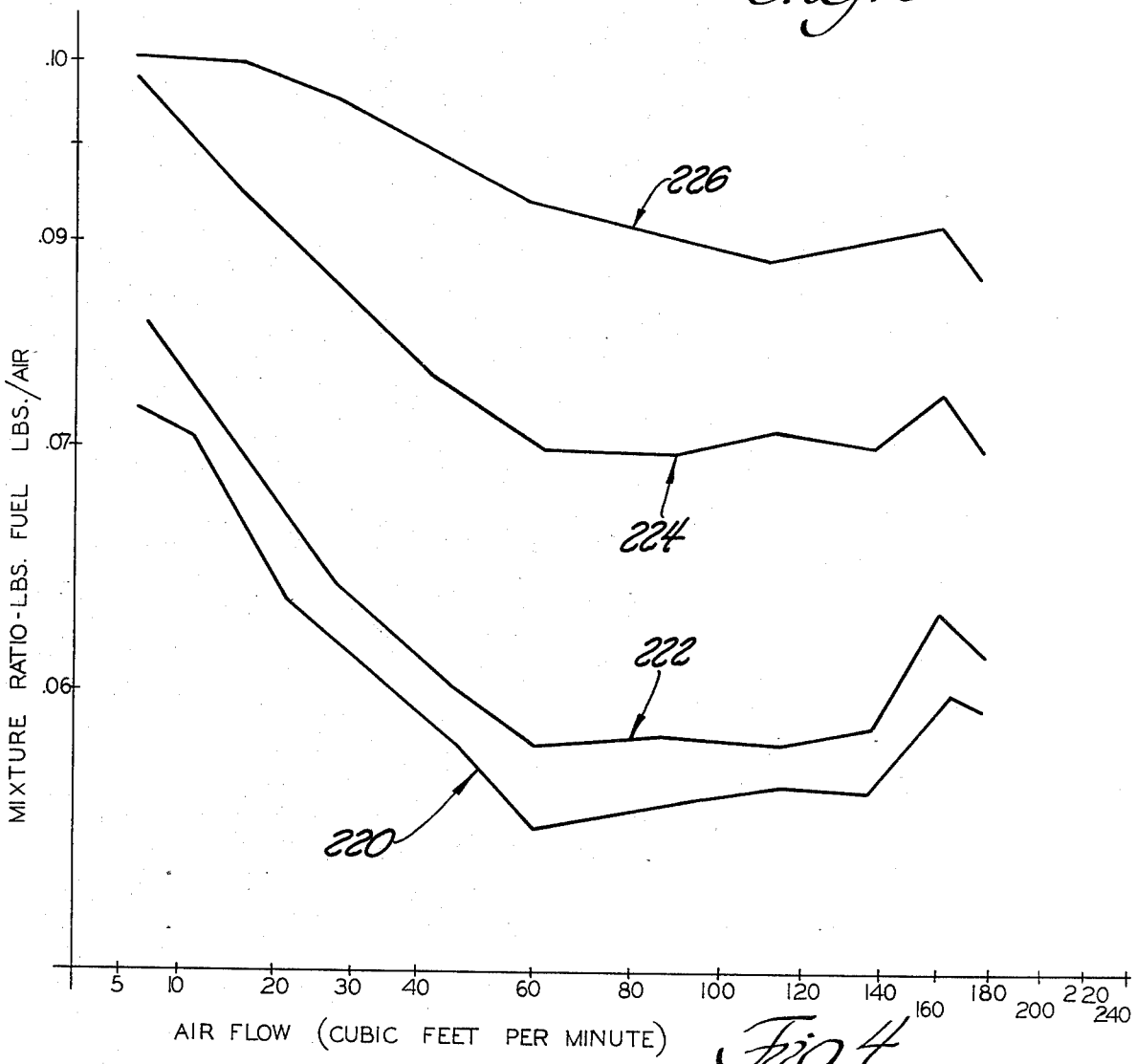
FIG. 4 is a graph depicting fuel-air ratio curves obtained from one particular tested embodiment employing teachings of the invention.

FIG. 4 illustrates fuel-air mixture curves, obtained during testing of one particular embodiment employing teachings of the invention with such curves being obtained at various magnitudes of control vacuum to the carburetor. That is, flow curve 220 was obtained at a control vacuum of 5.0 inches of $H_g$; flow curve 222 was obtained at 4.0 inches of $H_g$; flow curve 224 was obtained at 2.5 inches of $H_g$ while flow curve 226 was obtained at 1.0 inch of $H_g$. It should be noted that at the maximum applied vacuum (5.0 inches of $H_g$) flow curve 220 corresponds generally to a typical part throttle fuel delivery curve while the flow curve 226 at minimum vacuum (1.0 inch of $H_g$) corresponds generally to a typical best engine power or wide open throttle delivery curve. Accordingly, it can be seen that in the event of a total electronic or vacuum failure in the system disclosed, the associated vehicle remains drivable regardless of whether such failure results in maximum or minimum applied vacuum or anywhere in between.

Referring in greater detail to FIG. 5 and the logic circuitry illustrated therein, the oxygen sensor 178 produces a voltage input signal along conductor means 162, terminal 310 and conductor means 308 to the input terminal 303 of operational amplifier 301. Such input signal is a voltage signal indicative of the degree of oxygen present in the exhaust gases and sensed by the sensor 178.

Amplifier 301 is employed as a buffer and preferably has a very high input impedence. The output voltage at output 306 of amplifier 301 is the same magnitude, relative to ground, as the output voltage of the oxygen sensor 178. Accordingly, the output at terminal 306 follows the output of the oxygen sensor 178.

The output of amplifier 301 is applied via conductor means 320 and resistance 322 to the inverting input terminal 314 of amplifier 312. Feedback resistor 313 causes amplifier 312 to have a preselected gain so that the resulting amplified output at terminal 318 is applied via conductor means 338 to the inverting input 332 of amplifier 330. Generally, at this time it can be seen that if the signal on input 314 goes positive (+) then the output at terminal 318 will go negative (−) and if the input at terminal 332 of amplifier 330 goes negative (−) then the output at 336 of amplifier 330 will go positive (+).

The input 316 of amplifier 312 is connected as to the wiper of potentiometer 328 in order to selectively establish a set-point or a reference point bias for the system which will then represent the desired or reference value of fuel-air mixture and to then be able to sense deviations therefrom by the value of the signal generated by sensor 178.

Switch means 368, which may comprise the transducer switching (or equivalent structure) means 182, when closed, as when the engine is below some preselected temperature, causes transistor 344 to go into conduction thereby establishing a current flow through the emitter 348 and collector 392 thereof and through resistor means 396, point 388 and through resistor 400 to ground 406. The same happens when, for example, switch means 378, which may comprise the throttle operated switch 181, is closed during WOT operation. During such WOT conditions (or ranges of throttle opening movement ) it is transistor 346 which becomes conductive. In any event, both transistors 344 and 346, when conductive, cause current flow into resistor 400.

An oscillator circuit comprises resistor 342, amplifier 330 and capacitor 402. When voltage is applied as to the left end of resistor 342, current will flow through such resistor 342 and tend to charge up capacitor 402. If it is assumed, for purposes of discussion, that the potential of the inverting input 332 is for some reason lower than that of the non-inverting input 334, the output of the operational amplifier at 336 will be relatively high and near or equal to the supply voltage of all of the operational amplifiers as derived from the zener diode 456. Consequently, current will flow as from point 367 through resistor 360 to point 365 and conductor 359, leading to the non-inverting input 334 of amplifier 330, and through resistor 363 to ground at 361. Therefore, it can be seen that when amplifier 330 is in conduction, there is a current component through resistor 360 tending to increase the voltage drop across resistor 363.

As current flows from resistor 342, capacitor 402 undergoes charging and such charging continues until its potential is the same as that of the non-inverting input 334 of amplifier 330. When such potential is attained, the magnitude of the output at 336 of operational amplifier is placed at a substantially ground potential and effectively places resistor 360 to ground. Therefore, the magnitude of the voltage at the non-inverting input terminal 334 suddenly drops and the inverting input 332 suddenly becomes at a higher potential than the non-inverting input 334. At the same time, resistor 362 is also effectively to ground thereby tending to discharge the capacitor 402.

The capacitor 402 will then discharge thereby decreasing in potential and approaching the now reduced potential of the non-inverting input 334. When the potential of capacitor 402 equals the potential of the non-inverting input 334, then the output 336 of amplifier 330 will suddenly go to its relatively high state again and the potential of the non-inverting input 334 suddenly becomes at a much higher potential than the discharged capacitor 402.

The preceding oscillating process keeps repeating.

The ratio of "on" time to "off" time of amplifier 330 depends on the voltage at 388. When that voltage is high, capacitor 402 will charge very quickly and discharge slowly, and amplifier 330 output will stay low for a long period. Conversely, when voltage at 388 is low, output of amplifier 330 will stay high for a long period.

The consequent signal generated by the turning "on" and turning "off" of amplifier 330 is applied to the base circuit of the Darlington circuit 410. When the output of amplifier 330 is "on" or as previously stated relatively high, the Darlington 410 is made conductive thereby energizing winding 429 of the solenoid valve assembly 172. Diode 442 is provided to suppress high voltage transients as may be generated by winding 429 while the LED may be employed, if desired, to provide visual indication of the operation of the winding 429.

As should be evident, the ratio of the "on" or high output time of amplifier 330 to the "off" or low output time of amplifier 330 determines the relative percentage or portion of the cycle time at which coil 429 is energized thereby directly determining the effective orifice opening or the effective magnitude of the control vacuum controlled by the valve member positioned by the energization of coil 429.

The solenoid assembly includes coil 429, as shown in FIGS. 5 and 6. The armature 556 is positioned in chamber 616 according to the magnetic field set up by coil 429. When there is no current in coil 429, the armature is positioned by spring 23 in an extended position; when current flows in coil 429, it creates a magnetic force that urges the armature against spring 23. When the current created magnetic force is larger than the spring force, the armature moves; conversely, when the current created magnetic force is smaller than spring 23 force, the armature moves. Transit time of the armature between the two stabile positions is generally a small percent of the time required for a cycle. It follows, therefore, that the output of the solenoid assembly is a function of current. Any factor that changes the instantaneous value of current will affect the solenoid output, and this can be measured. For example, if diode 442 (FIG. 5) were replaced with a Zener diode, the current decay in coil 429 will be more rapid. This, in turn, would cause the armature 556 to move earlier in the cycle as a result of spring 23 force, lowering the output signal. A second alternative would be to omit diode 442 and connect a Zener diode from point 436 to ground 425, in which event the current decay in coil 429 would be increased. As described above, the more rapid current decay will decrease the output vacuum signal.

Assuming now, for purposes of description, that the output of oxygen sensor 178 has gone positive (+) or increased meaning that the fuel-air mixture has become enriched (in terms of fuel). Such increased voltage signal is applied to input 314 of amplifier 312 and the output 318 of amplifier 312 drops in voltage because of the inverting of input 314. Because of this less voltage is applied to the resistor 342 and therefore it takes longer to charge up capacitor 402. Consequently, the ratio of the "on" or high output time to the "off" or low output time of amplifier 330 increases. This ultimately results in applying more average current to the coil 429 which, in turn, means more vacuum being applied to the vacuum motors 102 and 104 of FIG. 2.

It should now also become apparent that with either or both switch means 368 and 378 being closed a greater voltage is applied to resistor 342 thereby reducing the charging time of the capacitor 402 with the result, as previously described, of altering the ratio of the "on" time to "off" time of amplifier 330.

When current, as through Darlington 440, is applied to coil or winding 429 of FIG. 6, the resulting magnetic field pulls armature valve member 556 to the right, as viewed in FIG. 6, causing valve portion 610 to sealingly seat against valve seat 602 and thereby terminate any communication as between passage 576 and chamber 616. When the current through Darlington 440 is terminated, as during periods when the output of amplifier 330 is low or "off", the magnetic field created by the winding 429 ceases to exist and spring 614 moves valving member 556 to the left causing valve portion 608 to sealingly seat against valve seat 612 to terminate communication as between passage 520 and chamber 616. Accordingly, it can be seen that, generally, when excess fuel richness is sensed (or amplifier 330 is "on"), communication as between passage 576 and chamber 616 is terminated while communication between passage 520 and chamber 616 is completed. Likewise, generally, when an insufficient rate of fuel is being supplied and sensed (or amplifier 330 is "off") communication as between passage 576 and chamber 616 is completed while communication between passage 520 and chamber 616 is terminated.

Now referring more specifically to FIG. 6, when valving member 556 is seated against valve seat 612, atmospheric pressure is communicated via conduit 630, chamber 596, through suitable passage means 592, 594, annulus 598, passage means 588, 590, passage 586 restriction 604, passage 576, axially past valving body 562 and into the left end of chamber 616 from where it is communicated via conduit means 618, 158, 152 and 154, 156 to chambers 106 and 124 of pressure responsive motor means 102 and 104 causing valving means 114 and 142 to move some distance downwardly as viewed in FIG. 2. At this time, the source of vacuum supplies such vacuum via conduit 190, passage means 522, chamber 516 and restriction 626 into passage 520 which is closed at its other end by the seated valve portion 608.

When valving member 556 is seated against valve seat 602, vacuum is communicated via conduit 190, passage means 522, chamber 516, restriction 626, passage 520 and into the left end of chamber 616 from where it is communicated via conduit means 618, 158, 152 and 154, 156 to chambers 106 and 124 of pressure responsive motor means 102 and 104 causing valving means 114 and 142 to move some distance upwardly as viewed in FIG. 2. At this time, the atmospheric pressure in chamber 596 and communicated to passage 576 is prevented from further communication because of seated valve portion 610. As should be apparent, the control valve assembly 172 functions to in effect mix two different pressure sources as to result in a control vacuum, $V_c$, of the then desired magnitude in order to achieve the proper end result.

Further, if it is assumed, at least for purposes of discussion, that the vacuum source represents a first relatively low and stable pressure and that the source of ambient atmospheric pressure represents a second relatively high and stable pressure, then it can be seen that within a selected overall time span, the greater the percentage of such time spent by valving member 556 seated against valve seat 612 the greater will be the magnitude (absolute pressure) of the control pressure or control vacuum, $V_c$, in conduit 158, while the greater the percentage of such overall time spent by valving member 556 seated against valve seat 602 the lesser will be the magnitude (absolute pressure) of the control pressure or control vacuum, $V_c$, in conduit 158.

Referring primarily to the left side of FIG. 6, diaphragm 508, valve 544, coacting end of extension 550 and end of passage 522, as well as springs 540 and 546 function, in effect, as a pressure regulator. That is, generally, in the absence of any vacuum within chamber 516, the preload of and force of spring 546 are sufficient to move valve 544 and diaphragm 508, against the resilient resistance of spring 540, to the left as to cause, for example, diaphragm backing plate 524 to abut against the juxtaposed inner surface of housing section 502. However, upon the introduction of vacuum into chamber 516, the resulting force from the pressure differential across diaphragm 508 added to the force of spring 540 is sufficient to move diaphragm 508 and valve 544 toward the inner open end of passage or conduit means 520 and the corresponding end of housing extension 550. Generally, the greater the magnitude (the lower the absolute pressure) of the vacuum in chamber 516, the closer will valve 544 move toward the said inner open end of conduit means 520. At times, if necessary, such movement of diaphragm 508 and valve 544 may be sufficient to intermittently fully close the said open inner end of conduit 520 to thereby terminate communication between conduit 520 and chamber 516. In this regard, screw 534 and spring 540 are employable for adjustably selecting (calibrating) the responsiveness of the diaphragm assembly in order to regulate the effective pressure drop across the coacting open end of conduit 522 and valve member 544 in order to attain a regulated resulting pressure within chamber 516. In one successful embodiment of the invention the magnitude of the regulated pressure (vacuum) within chamber 516 was in order of 5.25 inches of Hg.

Figure 7:
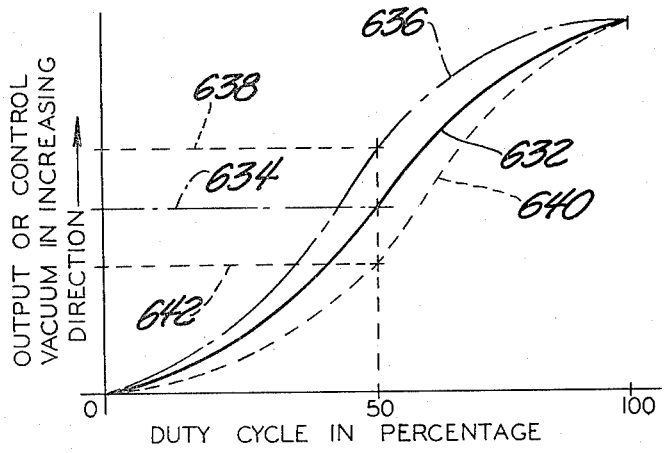
FIG. 7 is a graph illustrating, typically, operating characteristics of the control valve assembly of FIG. 6.

Another important benefit provided by the invention is the provision of calibrated passage or restriction means 604 and 626. It has been discovered that the relationship between the duty cycle of the solenoid assembly (duty cycle being that portion of a particular time span in which the field or solenoid coil is energized as to cause valve means 556 to be seated against valve seat 602) and the magnitude of the output vacuum as measured, for example, in conduit means 618 can be varied without varying the duty cycle or changing any of the related electronics. FIG. 7 graphically illustrates such relationships. Referring in greater detail to FIG. 7, the graph illustrated therein has the varying values of output or control vacuum, $V_c$, generally plotted along the vertical axis thereof while the duty cycle, expressed in terms of percentage, is plotted along the horizontal axis thereof.

If it is now assumed that a particular curve 632 is obtainable with a first particular set of calibrated restrictions 604 and 626, with a 50% duty cycle producing a resulting magnitude of control vacuum as indicated by line 634, what has been discovered is that by either relatively enlarging the size of restriction 626 or relatively decreasing the size of restriction 604 will result in such operating curve shifting from the solid line position at 632 to the broken line position at 636 with the result that the same 50% duty cycle now produces a significantly increased magnitude of control vacuum, $V_c$, as indicated by line 638. Similarly, it has been discovered that by either relatively decreasing the size of restriction 626 or relatively increasing the size of restriction 604 such operating curve will shift from the solid line position at 632 to the broken line position at 640 with the result that the same 50% duty cycle now produces a significantly decreased magnitude of control vacuum, $V_c$, as indicated by line 642. Accordingly, such characteristics may be employed for accommodating the responsiveness peculiar to any particular related operating structure operatively connected to conduit 158 without the need for major changes in the control valve assembly 172. Further, restrictions 626 and 604 also serve as pressure-like filters as, for example, preventing a sudden change of large magnitude in the pressure within chamber 516 when valve means 556 is seated against seat 602.

Such characteristics, as generally depicted in FIG. 7, may also be achieved by changing the current. For example, increasing the voltage applied to coil 429 will increase the current, as typically depicted at 636; decreasing the voltage will decrease the current and thereby shift the operating curve to a position typically illustrated at 640. The resistance of coil 429 also changes with temperature. Therefore, an increase in resistance due to an increase in temperature will decrease the current, when voltage is held constant, and thereby shift the operating curve to a position typically illustrated at 640. Also, a decrease in resistance due to a decrease in temperature will increase the current, when voltage is held constant, and thereby shift the operating curve to a position typically illustrated at 636.

The invention as disclosed in FIG. 6, although not so limited, is primarily intended for use in systems wherein the pressure responsive motor means (such as 102 and 104 of FIG. 2) operated thereby define effectively dead chambers 106 and 124 as to be more in the nature of a static pressure system rather than a flow pressure system.

Figure 8:
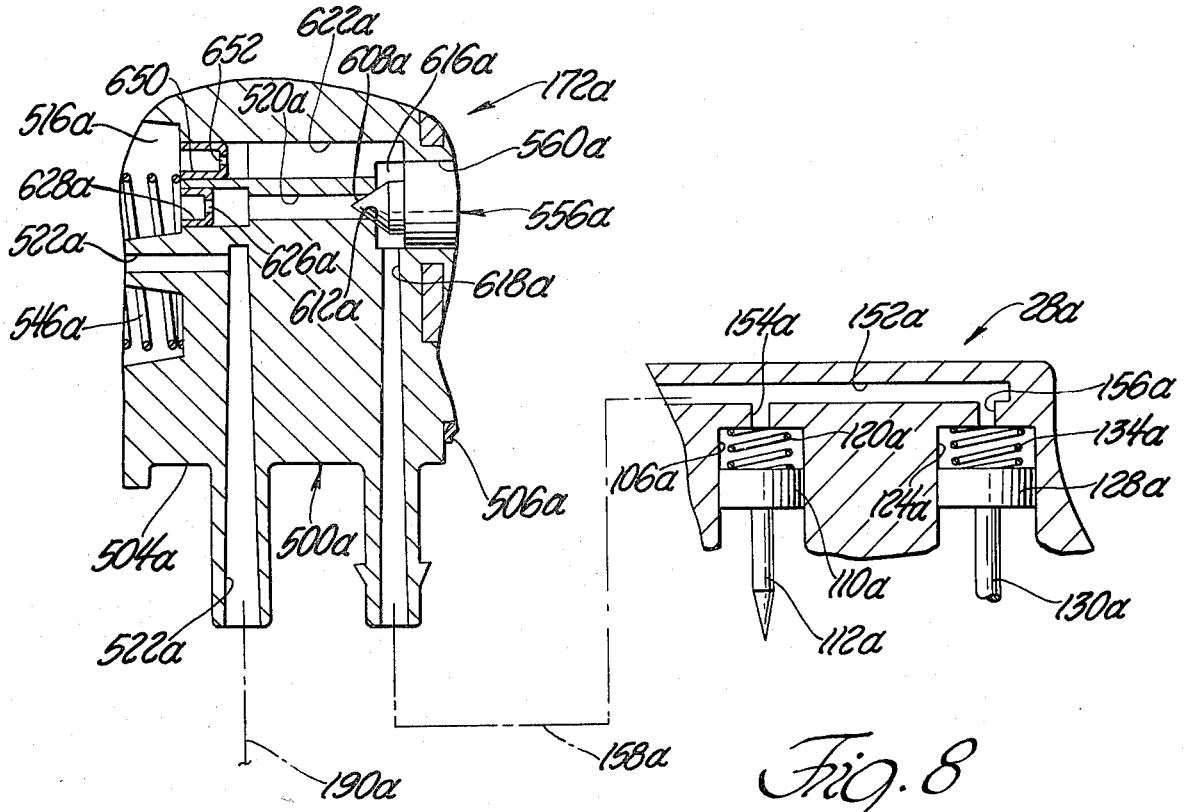
FIG. 8 is a view illustrating a fragmentary portion of a modification of the invention.

The modification of the invention as fragmentarily (and somewhat schematically) illustrated in FIG. 8 is primarily intended for such flow pressure systems where it is anticipated that at least relatively small flows, even in the nature of what might be referred to as leakage type flows, will occur through chambers functionally equivalent to chambers 106 and 124.

In FIG. 8, those elements and/or elements which are like or similar to those of the preceding Figures are identified with like reference numbers provided with a suffix "a". (The portion of control valve assembly **172*a* not shown in FIG. 8 may be assumed, for purposes of discussion, to be identical to that of control valve assembly 172 of FIG. 6**.)

Referring now in greater detail to FIG. 8, it can be seen that, by way of example, diaphragms 110 and 128 have been functionally replaced by piston means 110*a* and 128*a*, respectively, thereby, in such an arrangement, anticipating that some degree of flow will occur past such pistons 110*a* and 128*a* from the relatively higher pressure area below them to the relatively lower pressure within the respective control chambers 106*a* and 124*a*. Further, it can be seen that in control valve means 172*a* a cup-like member 650, having a calibrated orifice or restriction 652 formed in the end wall thereof, is sealingly press fitted into conduit means 622*a* as to thereby complete communication, through restriction 652, between chamber 516*a* and conduit or passage means 622*a* which, in turn, is always in communication with conduit means 618*a* as through the left end of chamber 616*a* generally defined by inner cylindrical surface 560*a*. As a consequence, it can be seen that a controlled or metered amount of vacuum is continually applied to passage 618*a*, passage 158*a*, passage 152*a*, conduit portions 154*a* and 156*a* and into chambers 106*a* and 124*a* even when valving member 556*a* is seated against valve seat 612*a*. Such restriction means 652 and passage means 622*a* function as a gain control or damping means in that the slight constant flow of vacuum prevents the piston means 110*a* and 128*a* (or a single piston member replacing such individual pistons) from over reacting to changes initially sensed as at the oxygen sensor 178. That is, by use of such vacuum bleed means 652, it is possible to further tailor the slope and other characteristics of the curves shown in FIG. 7 in order to thereby prevent the responding piston means from going into a "hunting" condition. By the term "hunting" is meant that somewhat unstable condition wherein a responding member responds to a degree too great for the signal applied thereto indicating a required response and subsequently, likewise, over-correcting for such initial over-response. Generally, as should be apparent, the provision of such a restriction means 652 and passage 622*a* has the effect of raising the output curve (as curve 632 of FIG. 7) in the lower duty cycle range. Preferably, the size of orifice means 652 is very small compared to calibrated orifices 626*a* 604 (FIG. 6); therefore it tends to raise the said output curve of the lower duty cycle while having a very minimal effect at the higher duty cycle. Therefore, by changing the relative size of restriction means 652, it becomes possible to change the slope of the output curve 632.

Although only a preferred embodiment and a modification of the invention have been disclosed and described, it is apparent that other embodiments and modifications of the invention are possible within the scope of the appended claims.

We claim:

1. In combination with a carburetor for a combustion engine wherein said carburetor comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through each of said main fuel metering system means and said idle fuel metering system means, said modulating valving means being effective to so alter said rate of metered fuel flow in response to control signal means generated as a consequence of selected indicia of engine operation, said modulating valving means comprising housing means, first conduit means carried by said housing means for supplying an output fluid pressure of a variable and controlled magnitude to said fuel metering system means, second conduit means leading to a source of relatively low fluid pressure, third conduit means leading to a source of relatively high fluid pressure, valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing communication as between said second conduit means and said first conduit means, and first and second calibrated restriction means, said first restriction means being in circuit with said second conduit means to control the rate of flow through said second conduit means when said valve means is in said second of said selected positions, and said second restriction means being in circuit with said third conduit means to control the rate of flow through said third conduit means when said valve means is in said first of said selected positions.

2. The combination according to claim 1 and further comprising solenoid winding means, said winding means when electrically energized being effective to move said valve means to one of said at least two selected positions.

3. The combination according to claim 1 and further comprising spring means effective for urging said valve means toward said first selected position, and solenoid winding means effective when electrically energized to move said valve means against said spring means and toward said second selected position.

4. The combination according to claim 1 and further comprising fourth conduit means, said fourth conduit means being effective for continually communicating between said source of relatively low fluid pressure and said first conduit means, and third calibrated restriction means in circuit with said fourth conduit means for controlling the rate of fluid flow through said fourth conduit means.

5. The combination according to claim 4 wherein said third calibrated restriction means has an effective flow area substantially less than the effective flow areas of said first and second calibrated restriction means.

6. The combination according to claim 4 wherein said source of relatively low fluid pressure comprises vacuum produced by said engine during operation thereof, and wherein said source of relatively high fluid pressure comprises atmospheric pressure.

7. The combination according to claim 1 wherein said source of relatively low fluid pressure comprises vacuum produced by said engine during operation thereof, and wherein said source of relatively high fluid pressure comprises atmospheric pressure.

8. A control valve assembly for producing an output fluid control pressure of varying predetermined magnitudes, comprising housing means, first conduit means carried by said housing means for supplying said output fluid control pressure to associated operating apparatus, second conduit means carried by said housing means leading to a first source of relatively low fluid pressure, third conduit means leading to a second source of relatively high fluid pressure, valve means operatively carried by said housing means movable to at least first and second operating positions, said valve means being effective when in said first operating position to close communication as between said first and second conduit means while completing communication between said first and third conduit means, said valve means also being effective when in said second operating position to close communication as between said first and third conduit means while completing communication as between said first and second conduit means, wherein said second and third conduit means respectively comprise first and second calibrated passage means, and actuating means effective for actuating said valve means as to cause said valve means to alternately move to said first and second operating positions in order to thereby alternately complete said communication between said first and second conduit means and said first and third conduit means thereby producing said output fluid control pressure within said first conduit means of a resulting magnitude which is not less than the magnitude of said relatively low fluid pressure and which is not greater than the magnitude of said relatively high fluid pressure.

9. A control valve assembly according to claim 8 and further comprising fourth conduit means, said fourth conduit means being effective for continually communicating between said first source of relatively low fluid pressure and said first conduit means, and wherein said fourth conduit means comprises third calibrated passage means effective for controlling the rate of fluid flow therethrough.

10. A control valve assembly according to claim 8 wherein said actuating means comprises resilient means effective for urging said valve means toward one of said operating positions, and electrical coil means effective upon being energized for moving said valve means toward the other of said operating positions.

11. A control valve assembly according to claim 8 wherein said actuating means is effective to cause said valve means to at times remain proportionately longer in said first operating position thereby relatively increasing the magnitude of said resulting magnitude as to more nearly approach the magnitude of said relatively high fluid pressure, and wherein said actuating means is also effective to cause said valve means to at other times remain proportionately longer in said second operating position thereby relatively decreasing the magnitude of said resulting magnitude as to more nearly approach the magnitude of said relatively low fluid pressure.

12. A control valve assembly according to claim 11 wherein said actuating means comprises resilient means effective for urging said valve means toward one of said operating positions, and electrical coil means effective upon being energized for moving said valve means toward the other of said operating positions.

13. A control valve assembly according to claim 12 wherein said one of said operating positions comprises said first operating position, and wherein said other of said operating positions comprises said second operating position.

14. A control valve assembly according to claim 8 wherein said second conduit means comprises serially interposed chamber means, and second valving means effective for variably restricting flow through said chamber means in order to maintain the magnitude of the fluid pressure within said chamber means within preselected limits.

15. A control valve assembly according to claim 14 wherein said first calibrated passage means is generally circuit-wise between said chamber means and said first conduit means.

16. A control valve assembly according to claim 14 and further comprising fourth conduit means comprising third calibrated passage means continually communicating between said chamber means and said first conduit means.

17. A control valve assembly according to claim 14 wherein said housing means comprises first second and third housing sections, wherein said first and second conduit means are carried by said first housing section, wherein said second valving means comprises pressure responsive diaphragm means supporting a valve member thereon for movement therewith, wherein said second housing section cooperates with said first housing section to generally peripherally retain said diaphragm means therebetween, wherein said chamber means is defined generally between said diaphragm means and said first housing section, wherein said second conduit means comprises first and second open ends communicating with said chamber means, first spring means situated generally in said chamber means and resiliently urging said valve member and said diaphragm means in a direction away from one of said open ends, second spring means situated generally between said second housing section and said diaphragm means for resiliently urging said valve member and said diaphragm means in a direction toward said one of said open ends, and further comprising adjustment means effective for adjustably selecting a preload force in said second spring means, wherein said first housing section comprises a tubular extension, wherein said first mentioned valve means is slidably received within said tubular extension and effective to undergo reciprocating movement therein, wherein said first mentioned valve means comprises a valve body, a first valve portion carried at one end of said valve body and a second valve portion carried at an other end of said valve body opposite to said one end, wherein said first conduit means communicates with the interior of said tubular extension, and further comprising first valve seat means formed generally about said second conduit means and generally facing into said interior of said tubular extension, said first valve seat being engageable by one of said valve portions when said first mentioned valve means is in said first operating position thereby preventing communication of said second conduit means with said interior of said tubular extension, wherein said actuating means comprises electrically energizable coil means, said coil means being carried by support spool type bobbin means, wherein said bobbin means is closely received about said tubular extension, wherein said bobbin comprises radially extending axially spaced first and second wall portions, and further comprising a pole member received within the open end of tubular extension as to generally axially contain said first mentioned valve means within said interior, wherein said third conduit means is at least in part formed through said pole member, said third conduit means having an open end opening into said interior, a second valve seat formed generally about said open end of said third conduit means and being effective to at times be operatively engaged by the other of said valve portions to terminate flow from said third conduit means and into said interior of said tubular extension, and wherein said third housing section is effective for enveloping said pole member coil and bobbin and to retain such in assembled relationship onto said first body section.

18. In combination with a carburetor for a combustion engine wherein said carburetor comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through each of said main fuel metering system means and said idle fuel metering system means, said modulating valving means being effective to so alter said rate of metered fuel flow in response to control signal means generated as a consequence of selected indicia of engine operation, said modulating valving means comprising first conduit means for supplying an output fluid pressure of a variable and controlled magnitude to said fuel metering system means, second conduit means leading to a source of relatively low fluid pressure, third conduit means leading to a source of relatively high fluid pressure, valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing communication as between said second conduit means and said first conduit means, and first and second calibrated restriction means, said first restriction means being in circuit with said second conduit means to control the rate of flow through said second conduit means when said valve means is in said second of said selected positions, and said second restriction means being in circuit with said third conduit means to control the rate of flow through said third conduit means when said valve means is in said first of said selected positions.

19. The combination according to claim 18 and further comprising solenoid winding means, said winding means when electrically energized being effective to move said valve means to one of said at least two selected positions.

20. The combination according to claim 18 and further comprising spring means effective for urging said valve means toward said first selected position, and solenoid winding means effective when electrically energized to move said valve means against said spring means and toward said second selected position.

21. The combination according to claim 18 and further comprising fourth conduit means, said fourth conduit means being effective for continually communicating between said source of relatively low fluid pressure and said first conduit means, and third calibrated restriction means in circuit with said fourth conduit means for controlling the rate of fluid flow through said fourth conduit means.

22. The combination according to claim 21 wherein said third calibrated restriction means has an effective flow area substantially less than the effective flow areas of said first and second calibrated restriction means.

23. The combination according to claim 21 wherein said source of relatively low fluid pressure comprises vacuum produced by said engine during operation thereof, and wherein said source of relatively high fluid pressure comprises atmospheric pressure.

24. The combination according to claim 18 wherein said source of relatively low fluid pressure comprises vacuum produced by said engine during operation thereof, and wherein said source of relatively high fluid pressure comprises atmospheric pressure.

25. In combination with a carburetor for a combustion engine wherein said carburetor comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through each of said main fuel metering system means and said idle fuel metering system means, said modulating valving means being effective to so alter said rate of metered fuel flow in response to control signal means generated as a consequence of selected indicia of engine operation, said modulating valving means comprising first conduit means for supplying an output fluid pressure of a variable and controlled magnitude to said fuel metering system means, second conduit means leading to a source of relatively low fluid pressure, third conduit means leading to a source of relatively high fluid pressure, and valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing communication as between said second conduit means and said first conduit means.

26. The combination according to claim 25 and further comprising solenoid winding means, said winding means when electrically energized being effective to move said valve means to one of said at least two selected positions.

27. The combination according to claim 25 and further comprising spring means effective for urging said valve means toward said first selected position, and solenoid winding means effective when electrically energized to move said valve means against said spring means and toward said second selected position.

28. The combination according to claim 25 and further comprising fourth conduit means, said fourth conduit means being effective for continually communicating between said source of relatively low fluid pressure and said first conduit means, and calibrated restriction means in circuit with said fourth conduit means for controlling the rate of fluid flow through said fourth conduit means.

29. The combination according to claim 28 wherein said source of relatively low fluid pressure comprises vacuum produced by said engine during operation thereof, and wherein said source of relatively high fluid pressure comprises atmospheric pressure.

30. The combination according to claim 25 wherein said source of relatively low fluid pressure comprises vacuum produced by said engine during operation thereof, and wherein said source of relatively high fluid pressure comprises atmospheric pressure.

31. In combination with a carburetor for a combustion engine wherein said carburetor comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through said main fuel metering system means, said modulating valving means being effective to so alter said rate of metered fuel flow in response to control signal means generated as a consequence of selected indicia of engine operation, said modulating valving means comprising first conduit means for supplying an output fluid pressure of a variable and controlled magnitude to said fuel metering system means, second conduit means leading to a source of relatively low fluid pressure, third conduit means leading to a source of relatively high fluid pressure, and valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing communication as between said second conduit means and said first conduit means.

32. The combination according to claim 31 and further comprising solenoid winding means, said winding means when electrically energized being effective to move said valve means to one of said at least two selected positions.

33. The combination according to claim 31 and further comprising spring means effective for urging said valve means toward said first selected position, and solenoid winding means effective when electrically energized to move said valve means against said spring means and toward said second selected position.

34. The combination according to claim 31 and further comprising fourth conduit means, said fourth conduit means being effective for continually communicating between said source of relatively low fluid pressure and said first conduit means, and calibrated restriction means in circuit with said fourth conduit means for controlling the rate of fluid flow through said fourth conduit means.

35. The combination according to claim 34 wherein said source of relatively low fluid pressure comprises vacuum produced by said engine during operation thereof, and wherein said source of relatively high fluid pressure comprises atmospheric pressure.

36. The combination according to claim 31 wherein said source of relatively low fluid pressure comprises vacuum produced by said engine during operation thereof, and wherein said source of relatively high fluid pressure comprises atmospheric pressure.

37. In combination with a carburetor for a combustion engine wherein said carburetor comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through said main fuel metering system means, said modulating valving means being effective to so alter said rate of metered fuel flow in response to control signal means generated as a consequence of selected indicia of engine operation, said modulating valving means comprising first conduit means for supplying an output fluid pressure of a variable and controlled magnitude to said fuel metering system means, second conduit means leading to a source of relatively low fluid pressure, third conduit means leading to a source of relatively high fluid pressure, valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing comunication as between said second conduit means and said first conduit means, and first and second calibrated restriction means, said first restriction means being in circuit with said second conduit means to control the rate of flow through said second conduit means when said valve means is in said second of said selected positions, and said second restriction means being in circuit with said third conduit means to control the rate of flow through said third conduit means when said valve means is in said first of said selected positions.

38. The combination according to claim 37 and further comprising solenoid winding means, said winding means when electrically energized being effective to move said valve means to one of said at least two selected positions.

39. The combination according to claim 37 and further comprising spring means effective for urging said valve means toward said first selected position, and solenoid winding means effective when electrically energized to move said valve means against said spring means and toward said second selected position.

40. The combination according to claim 37 and further comprising fourth conduit means, said fourth conduit means being effective for continually communicating between said source of relatively low fluid pressure and said first conduit means, and third calibrated restriction means in circuit with said fourth conduit means for controlling the rate of fluid flow through said fourth conduit means.

41. The combination according to claim 40 wherein said third calibrated restriction means has an effective flow area substantially less than the effective flow areas of said first and second calibrated restriction means.

42. The combination according to claim 40 wherein said source of relatively low fluid pressure comprises vacuum produced by said engine during operation thereof, and wherein said source of relatively high fluid pressure comprises atmospheric pressure.

43. The combination according to claim 37 wherein said source of relatively low fluid pressure comprises vacuum produced by said engine during operation thereof, and wherein said source of relatively high fluid pressure comprises atmospheric pressure.

44. Apparatus for controlling the air-fuel ratio supplied to a combustion engine, comprising a carburetor, said carburetor comprising induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through said main fuel metering system means, said modulating valving means being effective to so alter said rate of metered fuel flow in response to control signal means generated as a consequence of selected indicia of engine operation, said modulating valving means comprising first conduit means for supplying an output fluid pressure of a variable and controlled magnitude to said fuel metering system means, second conduit means leading to a source of relatively low fluid pressure, third conduit means leading to a source of relatively high fluid pressure, valve means movable to at least two selected positions and effective when in a first of said selected positions to close communication as between said second and said first conduit means while completing communication between said first conduit means and said third conduit means, said valve means being effective when in a second of said selected positions to close communication as between said first conduit means and said third conduit means while completing communication as between said second conduit means and said first conduit means, and first and second calibrated restriction means, said first restriction means being in circuit with said second conduit means to control the rate of flow through said second conduit means when said valve means is in said second of said selected positions, and said second restriction means being in circuit with said third conduit means to control the rate of flow through said third conduit means when said valve means is in said first of said selected positions.

45. Apparatus according to claim 44 and further comprising solenoid winding means, said winding means when electrically energized being effective to move said valve means to one of said at least two selected positions.

46. Apparatus according to claim 44 and further comprising spring means effective for urging said valve means toward said first selected position, and solenoid winding means effective when electrically energized to move said valve means against said spring means and toward said second selected position.

47. Apparatus according to claim 44 and further comprising fourth conduit means, said fourth conduit means being effective for continually communicating between said source of relatively low fluid pressure and said first conduit means, and third calibrated restriction means in circuit with said fourth conduit means for controlling the rate of fluid flow through said fourth conduit means.

48. Apparatus according to claim 47 wherein said third calibrated restriction means has an effective flow area substantially less than the effective flow areas of said first and second calibrated restriction means.

49. Apparatus according to claim 47 wherein said source of relatively low fluid pressure comprises vacuum produced by said engine during operation thereof, and wherein said source of relatively high fluid pressure comprises atmospheric pressure.

50. Apparatus according to claim 44 wherein said source of relatively low fluid pressure comprises vacuum produced by said engine during operation thereof, and wherein said source of relatively high fluid pressure comprises atmospheric pressure.

51. The combination according to claim 1 wherein said housing means comprises a housing structure separate from and in addition to such structure as defines said carburetor.

* * * * *